US006588041B1

(12) United States Patent
Cragg et al.

(10) Patent No.: US 6,588,041 B1
(45) Date of Patent: Jul. 8, 2003

(54) PRE-LOAD ADJUSTMENT FOR SPAN LOCK SYSTEM

(75) Inventors: Robert L. Cragg, Maple Glen, PA (US); James F. Alison, III, Birmingham, AL (US)

(73) Assignee: Steward Machine Co., Inc., North Birmingham, AL (US)

( * ) Notice: Subject to any disclaimer, the term of this patent is extended or adjusted under 35 U.S.C. 154(b) by 0 days.

(21) Appl. No.: 10/073,510

(22) Filed: Feb. 11, 2002

(51) Int. Cl.[7] ..... E01D 15/08
(52) U.S. Cl. ..... 14/46; 14/41
(58) Field of Search ..... 14/35, 38, 41, 14/46, 31

(56) References Cited

U.S. PATENT DOCUMENTS 685,768 A 11/1901 Keller
689,856 A 12/1901 Cummings
2,610,341 A 9/1952 Gilbert
2,759,430 A * 8/1956 Kelsey ..... 104/124
5,327,605 A 7/1994 Cragg ..... 14/41
6,453,494 B1 * 9/2002 Koglin ..... 14/41

* cited by examiner

*Primary Examiner*—Robert E. Pezzuto
*Assistant Examiner*—Alexandra K. Pechhold
(74) *Attorney, Agent, or Firm*—Howson & Howson

(57) ABSTRACT

A drawbridge span lock system in which a locking bar longitudinally slides between wear shoes in each of guide and socket assemblies. The wear shoes are pre-loaded to a selected level by springs within the assemblies to maintain continuous contact of the shoes with the locking bar under no-load operating conditions of the bridge. Threaded adjusting carriers externally accessible in each assembly enable the springs to be precisely pre-loaded to any level within a design range.

13 Claims, 2 Drawing Sheets

PRE-LOAD ADJUSTMENT FOR SPAN LOCK SYSTEM

BACKGROUND OF THE INVENTION

The present invention relates generally to energy-absorbing span lock system for drawbridges, and more particularly to a novel and improved apparatus for adjusting a pre-load in an energy-absorbing span lock system.

Span lock systems for drawbridges are designed to lock the outer ends of the two relatively movable leaves together when in the closed positions. Typically, a motor pushes a retractable steel locking bar longitudinally between wear shoes in a guide assembly on the outer end of one leaf into wear shoes in a socket assembly on the other leaf end. The locking bar maintains uniform deflection of the leaf ends by acting as a cantilever transmitting shearing stresses from one leaf to the other if there is any differential vertical loading due to vehicular traffic.

These systems generally allow a vertical clearance in the range of 0.010–0.025 inch between the sliding surfaces of the locking bar and the guide and socket assemblies under no bridge loads. However, wear due to vibration, pounding, poor maintenance, etc. the clearance may increase to 0.500 inch or more. This situation is dangerous and often manifests itself as problems or failures at other locations in the bridge such as in operating machinery gears and bearings, trunnion bearings, or live load shoe difficulties. My U.S. Pat. No. 5,327,605 issued Jul. 12, 1994 for an improved energy-absorbing span lock system for drawbridges is addressed to these problems. The wear shoes are continuously compressed against the top and bottom surfaces of the locking bar by energy-absorbing Belleville springs which cushion the effects of shock loads and vibrations. To prevent the locking bar from slamming against the shoes, the shoes are pre-loaded for zero clearance between the wear surfaces of the shoes and the locking bar by compressing the springs, under bridge no-load operating conditions, to maintain the shoes and locking bar in firm continuous contact. The springs have load-deflection characteristics which provide an approximate initial compression or pre-load when the shoes have been deflected by the fully inserted locking bar. The adjustment is usually done before the guide and socket assemblies are mounted on the bridge with out the locking bar inserted. Shims, composed of several laminations each 0.001 inch thick, are incrementally added as necessary in the vicinity of the springs until the deflection of the shoes, when the locking bar is inserted under no bridge load, compresses the springs to the desired pre-load. Adjustment is cumbersome due to the size and weight of the parts being handled, as well as time-consuming since it is a trial-and-error process that results in many assemble and disassemble iterations to add or subtract shims to reach the precise pre-load deflection. There is no provision for making these adjustments while in the assembled housing, and once installed on a bridge, any pre-load adjustment of the springs required to compensate for shoe wear, fatigue or deterioration of components is an extremely costly undertaking. The bridge must be taken out of service while the entire span lock system is removed to add or subtract shims.

SUMMARY OF THE INVENTION

Accordingly, it is an object of the present invention to provide a novel and improved drawbridge span lock system having an energy-absorbing adjuster device which can be pre-loaded a specified amount without clearance between the locking bar and the guide and socket assemblies under no-load conditions.

Another object of the invention is to provide an energy-absorbing device for a drawbridge span lock system in which a pre-load can be adjusted after being installed in bridge structure without prolonged interruption of service to vehicular traffic.

Another object of the invention is to provide an energy-absorbing adjuster device in a span lock system which can be precisely pre-loaded without clearance between the locking bar and the wear shoes to any of an infinite number of levels .

Still another object of the invention is to provide a method of pre-loading an energy-absorbing span lock system with substantially zero clearance between the locking bar and the guide and socket assemblies.

A still further object of the invention is to provide an energy absorbing device for a drawbridge span lock system which is easy to manufacture, operate and maintain.

These and other objects and of the invention are accomplished in a drawbridge span lock system in which a locking bar longitudinally slides between wear shoes in each of the guide and socket assemblies. The wear shoes are pre-loaded a selected amount by springs within the assemblies to maintain continuous contact of the shoes with the locking bar under no-load operating conditions of the bridge. Threaded adjusting carriers externally accessible in each assembly enable the springs to precisely pre-load the wear shoes to any amount within a design range.

BRIEF DESCRIPTION OF THE DRAWINGS

For a more complete understanding and appreciation of the invention and its many attendant advantages, reference will be made to the following detailed description taken in conjunction with the accompanying drawings wherein.

DESCRIPTION OF THE PREFERRED EMBODIMENT

Figure 1:
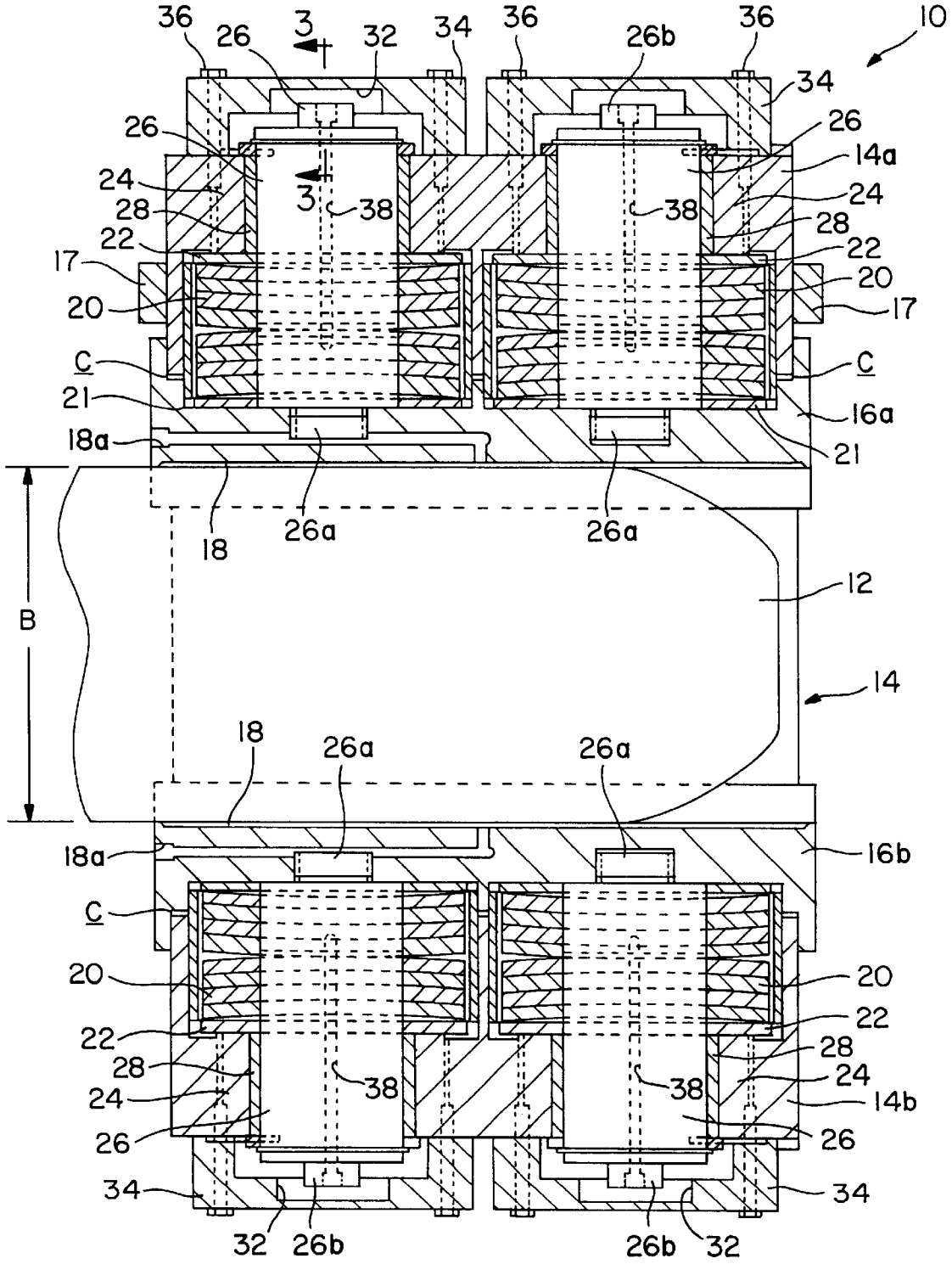
FIG. 1 represents an elevation view in partial cross section of an energy-absorbing bar guide assembly according to the invention suitable for use in a drawbridge span lock system.

Referring now to the drawings wherein like reference numerals and characters denote like or corresponding parts throughout the several views, FIG., 1 shows a novel resilient energy-absorbing bar guide assembly 10 according to the invention of a span lock system for connecting the outer ends of a double leaf bascule bridge under no load. In a manner similar to the span lock system disclosed in U.S. Pat. No. 5,327,605 supra, bar guide assembly 10 is to the span lock system disclosed in U.S. Pat. No. 5,327,605 supra, bar guide assembly 10 is adapted to be mounted on end structure of one bridge leaf for supporting a horizontal locking bar 12 of flat upper and lower sides. An actuating motor, not shown, longitudinally extends locking bar 12 into an aligned energy-absorbing bar socket assembly mounted on the outer end of the meeting bridge leaf. The guide and socket assemblies are substantially identical both in structure and function but differences as noted hereinbelow. It will be appreciated that the bar guide and socket assemblies of the present invention are applicable to other forms of drawbridges such as a single-leaf span where a movable leaf end connects to stationary structure.

Bar guide assembly 10 includes a housing 14 with opposed upper and lower sections 14*a* and 14*b* in which a horizontally locking bar 12 longitudinally slides between upper and lower wear shoes 16*a* and 16*b* which in turn slide vertically in respective housing sections 14*a* and 14*b*. Deflectors 17 extend from the opposite ends of upper section 14*a* to shield the shoe-housing interface from any falling water or debris. In order to control the tensile stresses developed in the spring corners to a magnitude that will insure infinite fatigue life of the springs, a clearance C is provided between each housing section 14*a* and 14*b* and the respective wear shoe 16*a* and 16*b* to limit to a predetermined maximum amount the spring deflection and resultant shoe movement. Shallow recesses 18 and connecting passages 18*a* in the shoes provide for lubricating the bar-shoe interfaces.

Shoes 16*a* and 16*b* are resiliently urged in continuous contact with an upper or lower surface of locking bar 12, respectively, by two parallel stacks 20 of Belleville disc springs compressed between the shoes and washers 22. A carrier 24 coaxial with each stack 20 and washers 22 threadingly engage housing 14 to retain the springs in compression. Stacks 20 each comprises two sets of springs stacked in series with the springs in each set stacked in parallel. It is understood, of course, that the load-deflection characteristics of the springs and clearance C are chosen to insure that wear shoes 16*a* and 16*b* bottom out in housing 14 at a calculated percentage of maximum shear load design carried over the ends of the bridge span.

To avoid misalignment or budding of the springs stacks 20, a cylindrical guide pin 26 rotatably extends through each stack and terminates in an extension 26*a* threadingly secured in shoes 16*a* and 16*b* respectively. Guide pin 26 also rotatably extends through a washer 21, spring stack 20, washer 22, a bushing 28 in carrier 24, and a washer 30. This construction permits the insertion of the springs, washers, bushings, and shoes onto carrier 24 already situated in housing 14. In the absence of locking bar 12, guide pin 26 and shoes 16*a* and 16*b* are prevented from accidently dropping out of housing 14 by washer 30 and retaining ring 31 seated in groove 26*b*. Guide pins 26 are also prevented from unscrewing from wear shoes 16*a* and 16*b* by rectangular tang 26*b* extending from the exposed end portion of each guide pin 26 by registering with a mating slot 32 in a cover 34 fixed to the outer surface of housing 14 by bolts 36. Lubricants to spring stacks 20 is provided through conduits 38 in guide pins 26.

Figure 2:
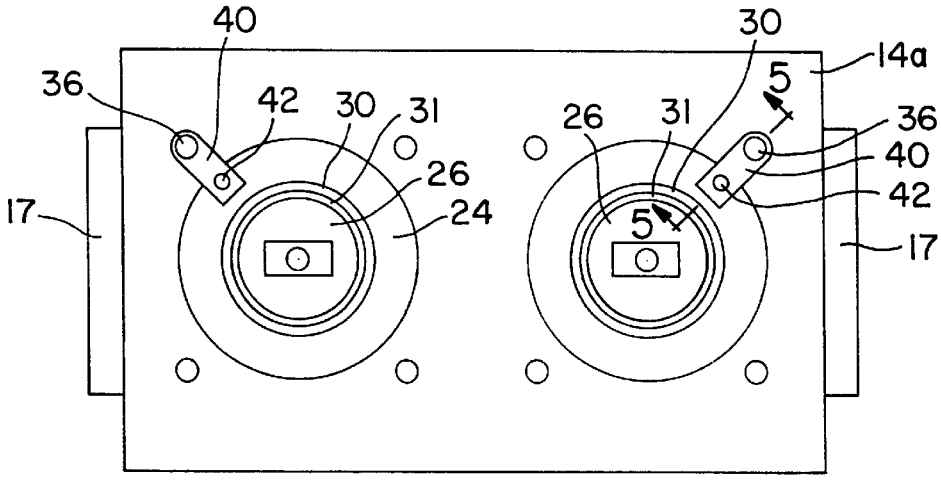
FIG. 2 represents a plan view of the guide assembly of FIG. 1 with covers removed from the upper surface.
Figure 3:
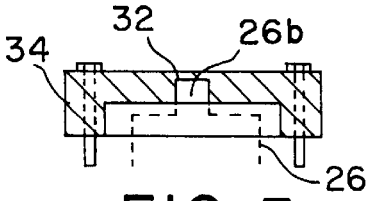
FIG. 3 represents a view of a cover of the guide assembly of FIG. 1 taken in cross section in plane along the line 3—3 thereof.
Figure 5:
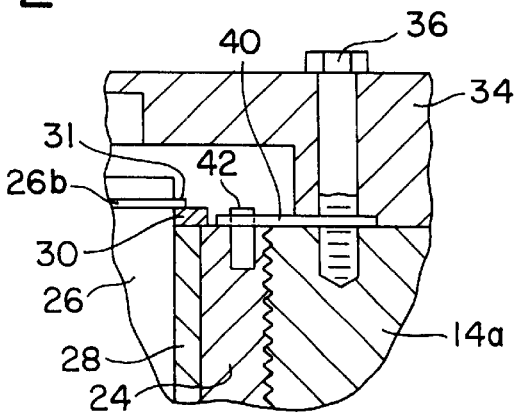
FIG. 5 is a fragmentary view in cross section of the guide assembly taken in a plane along the line 5—5 of FIG. 2 with a cover in FIG. 1 included.
Figure 4:
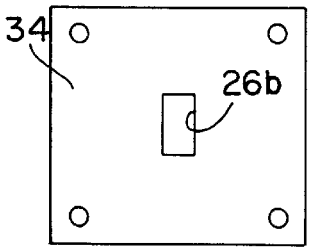
FIG. 4 represents a bottom view of the cover of FIG. 3.

Before installation on bridge structure, springs 20 are adjusted for a specified pre-load between the locking bar 12 and shoes 16*a* and 16*b*. The specified pre-load is an amount calculated so that the resulting tensile stresses when related to the spring tensile stress at full deflection assures infinite fatigue life. In the range of deflection to which the springs will be subjected, the relationship between the applied load and resultant spring deflection is nearly constant. Therefore the desired amount of interference between locking bar 12 and wear shoes. 16*a* and 16*b* may be accurately set by adjusting the shoes so that the distance between the wear surfaces is less than the height of the locking bar 12 by an amount equal to the required pre-load. Accordingly, spring stacks 20 are installed to approximate the pre-loading that will be required when locking bar 12 is inserted between shoes 16*a* and 16*b*. The pre-load is more precisely adjusted after springs 20 have been fully assembled and before inserting locking bar 12 by screwing threaded carriers 24 in or out of housing 14 until the distance D between the wear surfaces of shoes 16*a* and 16*b* is the required amount less than the height of locking bar 12. Both of these dimensions are obtained by use of accurate measuring instruments. Carrier 24, as best seen in FIGS. 2 and 5, is secured against drifting from the adjusted position by a lock tab 40 fixed at one end to an adjacent bolts 36 and at the other end to carrier 24 by a pin 42 extending from lock tab 40 into a hole drilled in carrier 24.

An example of adjusting a pre-load in a span lock system constructed according to the invention for a typical bascule bridge is briefly described as follows. For a maximum shear and bending load on locking bar 12 due to vehicular traffic on the bridge, it is determined that a locking bar 12 nominally six inches high by nine inches wide of high-strength, machine-finished steel is required. Spring stacks 20 are installed in both housing sections 14*a* and 14*b* having load-deflection characteristics whereby a total stack deflection d from zero spring compression will impart a specified pre-load on the top and bottom of locking bar 12 when inserted between wear shoes 16*a* and 16*b*.

Figure 6:
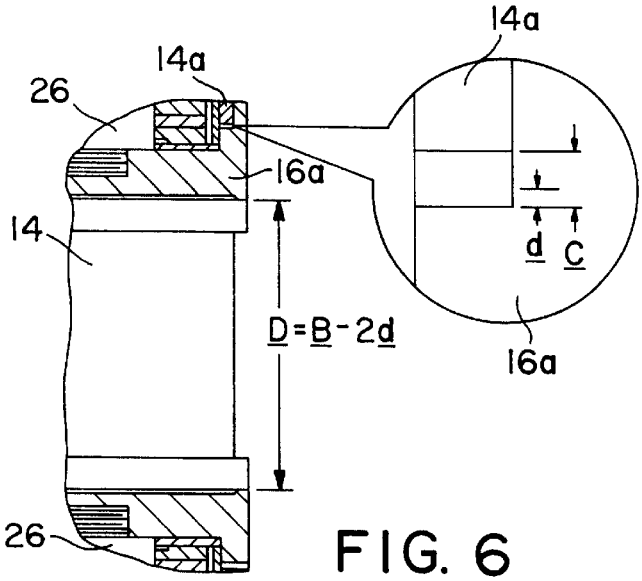
FIG. 6 illustrates, with an inset, the deflection parameters for pre-loading the bar guide assembly according to the invention under no-load operating conditions of a drawbridge.

Referring to the schematic diagram in FIG. 6, for the selected springs, calculations reveal that a 0.007 inches per spring pre-load is desirable. For this amount of pre-load, each shoe 16*a* and 16*b* will be pre-loaded a distance d equal to 0.014 inches, and the total pre-load on locking bar 12 will be 0.028 inches. Precise measurement of the locking bar 12 of six-inch nominal height revealed an actual height B of 5.996 inches; thus the no-load distance D between shoes 16*a* and 16*b* should be adjusted to 5.968 inches, i.e. 5.968–0.028, to achieve the proper pre-load. Accordingly shoes 16*a* and 16*b* are positioned firmly against their supporting springs 20 without deflecting them any measurable amount, and then carrier 24 is simply turned in or out to make shoes 16*a* and 16*b* closer together or farther apart until the precise required distance D is obtained between the opposed shoe surfaces. Carrier 24 and springs 20 are then fixed in their adjusted positions by drilling a hole in each exposed face of carriers 24 and engaging lock tab 40 and pin 42 between carriers 24 and housing 14.

Some of the many advantages and novel features of the invention should now be readily apparent. For instance, a pre-loaded energy-absorbing span lock system for drawbridges according to the invention as described assists in maintaining uniform defection at the meeting ends of the bridge leaves during passage of vehicular traffic. The system can be pre-loaded under no-load conditions for zero clearance between the locking bar and the guide and socket assemblies, and the pre-loaded can be adjusted after the system has been installed in bridge structure with a minimum interruption of service to vehicular traffic. The springs can be precisely pre-loaded without clearance between the locking bar and the wear shoes to any level within the design range. An improved method is disclosed for pre-loading an energy-absorbing span lock system with substantially zero clearance between the locking bar and the forward adjustment of the shoes completes the job. The system is constructed from readily available or manufactured components, and is easy to operate and maintain.

It will be understood, of course, that various changes in the details, materials, and arrangement of parts, which have been herein described and illustrated in order to explain the nature of the invention, may be made by those skilled in the art within the principles and scope of the invention as expressed in the appended claims.

We claim:

1. Apparatus for pre-load adjustment of a span lock system for a drawbridge having at least one span movable with respect to a complementary span, the system including a guide assembly and a socket assembly mounted on respective ends of the spans, and a locking bar longitudinally reciprocative between the guide and socket assemblies for securing the spans in the closed position, each of the assemblies comprising:

a housing having spaced opposed upper and lower sections;

wear shoes slidable in respective ones of said sections with facing surfaces formed to slidably receive the locking bar;

a plurality of springs operatively compressed between said sections and respective ones of said wear shoes; and a carrier interposed between respective ones of said springs and said wear shoes for adjusting a pre-load at the interface of said wear shoes and the locking bar, said carrier being threadingly engaged to said housing for adjusting the compression in the spring by screwing said carrier in and out of said housing for a desired pre-load.

2. Apparatus according to claim 1 further comprising:

a vertical clearance between each of said wear shoes and an associated one of said housing sections for permitting limited relative deflection of the ends of the spans.

3. Apparatus according to claim 1 further comprising a lock tab connected between said carrier and said housing for preventing said carrier from drifting from the adjusted position.

4. Apparatus according to claim 1 wherein each of said springs include at least one set of Belleville discs stacked in parallel.

5. Apparatus according to claim 4 wherein each of said springs further includes at least two of said sets stacked in series.

6. Apparatus according to claim 1 further comprising:

a guide pin vertically extending through each of said springs for preventing said springs from buckling or misalignment.

7. Apparatus according to claim 1 further comprising:

a guide pin extending through each said springs and threadingly connected at one end to a respective one of said wear shoes and defining an oblong tang at the other end; and a cover secured over each of said guide pins to the external surface of said housing and having a recess mating with said tang to prevent said guide pin from unscrewing from said wear shoes.

8. Apparatus according to claim 6 further comprising:

a bushing interposed between said guide pin and said carrier; and retainer means for securing said bushing in place.

9. A method for pre-loading a guide assembly or socket assembly of a drawbridge span lock system under no-load conditions, the assembly including opposed wear shoes slidable in a housing for receiving a locking bar, comprising the steps of:

selecting springs having load deflection characteristics suitable for providing a pre-load on each wear shoe corresponding to a spring deflection d measured from a position of zero spring compression;

installing the springs in the assembly to provide a distance between the wear shoes approximating the height B of the locking bar;

installing a carrier for adjusting a position of the wear shoes relative to the housing;

precisely measuring the height B of the locking bar, and adjusting the carrier with the wear shoes firmly held against the springs until a required distance D between the wear shoes equals the locking bar height B less a total pre-load deflection $2d$ of both wear shoes is obtained.

10. A method according to claim 9 further comprising the step of:

locking the carrier to the housing against turning at the required distance D.

11. A method for pre-loading a drawbridge span lock system having a locking bar slidable in a pair of opposed wear shoes in a guide assembly on one leaf of the bridge and a socket assembly on an adjoining leaf of the bridge, comprising the steps of:

selecting springs having load deflection characteristics for imparting a desired pre-load on the locking bar at a spring deflection measured from a position of zero spring compression;

installing the springs in each assembly to provide a distance between the wear shoes approximating a height of the locking bar;

precisely measuring the height of the locking bar; and adjusting the wear shoes with the wear shoes held firmly against the springs until a distance between the opposed wear shoes equals the locking bar height less a total pre-load deflection of both wear shoes.

12. An adjustable lock system for the leafs of a drawbridge, comprising:

a housing mounted on each of joining ends of the leafs, each housing defining upper and lower sections;

a wear shoe slidable in each of said sections forming upper and lower facing surfaces in each housing;

a locking bar slidable between said facing surfaces;

a spring disposed between each of said sections and said wear shoe slidable therein; and a carrier threadingly engaged in each of said sections for adjusting the compression in said spring by screwing said carrier in and out for a desired pre-load on said lock bar.

13. An adjustable lock system according to claim 12 further comprising a lock tab connected between each of said upper sections and said carrier therein for preventing said carrier from drifting from the adjusted compression.

* * * * *